US007498281B2

(12) United States Patent
Iwasaki et al.

(10) Patent No.: US 7,498,281 B2
(45) Date of Patent: Mar. 3, 2009

(54) NONWOVEN FABRIC AND TEA BAG

(75) Inventors: Hirohumi Iwasaki, Ashiya (JP); Hirohiko Nagao, Kobe (JP); Naoko Yamaguchi, Osaka (JP); Mitsunori Saito, Takatsuki (JP)

(73) Assignees: Asahi Kasei Fibers Corporation, Osaka-Shi (JP); Ohki Co., Ltd., Osaka-Shi (JP)

( * ) Notice: Subject to any disclaimer, the term of this patent is extended or adjusted under 35 U.S.C. 154(b) by 406 days.

(21) Appl. No.: 10/519,788

(22) PCT Filed: Jun. 24, 2003

(86) PCT No.: PCT/JP03/08005

§ 371 (c)(1),
(2), (4) Date: Dec. 29, 2004

(87) PCT Pub. No.: WO2004/003277

PCT Pub. Date: Jan. 8, 2004

(65) Prior Publication Data

US 2005/0255768 A1 Nov. 17, 2005

(30) Foreign Application Priority Data

Jul. 1, 2002 (JP) ..... 2002-192497
Jul. 1, 2002 (JP) ..... 2002-192507

(51) Int. Cl.
*B32B 5/26* (2006.01)
*B32B 27/32* (2006.01)
*D04H 3/16* (2006.01)
*A61F 13/15* (2006.01)

(52) U.S. Cl. ..... 442/382; 442/381; 442/392; 442/401; 428/219; 428/220

(58) Field of Classification Search ..... 442/401, 442/327, 392, 381, 382; 428/219, 220, 315.7
See application file for complete search history.

(56) References Cited

U.S. PATENT DOCUMENTS 4,582,666 A * 4/1986 Kenworthy et al. ..... 264/557

FOREIGN PATENT DOCUMENTS

| | | |
|---|---|---|
| JP | 6-181688 | 7/1994 |
| JP | 6-189853 | 7/1994 |
| JP | 7-136066 | 5/1995 |
| JP | 08-150079 | 6/1996 |
| JP | 9-105075 | 4/1997 |
| JP | 11-43855 | 2/1999 |
| JP | 11-107153 | 4/1999 |
| JP | 2000-226738 | 8/2000 |
| JP | 2001-063757 | 3/2001 |
| WO | WO 9850611 | * 11/1998 |
| WO | WO 02/48443 A1 | 6/2002 |

* cited by examiner

*Primary Examiner*—Lynda Salvatore
(74) *Attorney, Agent, or Firm*—Finnegan, Henderson, Farabow, Garrett & Dunner, L.L.P.

(57) ABSTRACT

A nonwoven fabric characterized in that the nonwoven fabric is a thermoplastic synthetic fiber nonwoven fabric having a fabric weight of 7 to 50 g/m$^2$, an average yarn diameter of 7 to 40 μm, a partial heat contact bonding ratio of 5 to 30% and a content of a delustering agent of 0.5% by weight or less, or a nonwoven fabric laminate the major component of which is the thermoplastic synthetic fiber nonwoven fabric, and that the nonwoven fabric has a maximum opening diameter of 200 to 2,000 μm, and shows a transparency of 50% or more, a powder leakage ratio of 10% by weight or less and a hydrophilicity of less than 10 sec, and a tea bag in which the nonwoven fabric is used.

10 Claims, 1 Drawing Sheet

NONWOVEN FABRIC AND TEA BAG

FIELD OF THE INVENTION

The present invention relates to a nonwoven fabric and a tea bag in which the nonwoven fabric is used.

BACKGROUND ART

When components of tea, such as black tea, green tea and oolong tea, are to be extracted, the tea bag system has often been used in a simple method. Generally, paper is often used as a tea bag material for a tea bag. However, because the paper has a dense structure, the paper used as a tea bag material includes the following problems: although the powder leakage is decreased, the paper shows poor transparency and tea leaves in a tea bag are hardly seen; and the paper cannot be heat sealed.

Furthermore, a nonwoven fabric of thermoplastic synthetic fiber has recently been used as a tea bag material. The nonwoven fabric is prepared by compositing a filaments yarn nonwoven fabric and an extremely thin yarn nonwoven fabric, and the powder leakage is decreased by utilizing a filtering effect of the extremely thin yarn. Such a conventional nonwoven fabric of thermoplastic synthetic fiber is excellent in that it can be heat sealed, and that the powder leakage is decreased. However, the nonwoven fabric has the problem that tea leaves in a tea bag cannot be seen due to insufficient transparency, and the like problem. In particular, when tea leaves of a high grade are used, that the state of tea leaves in a tea bag cannot be seen is a great disadvantage.

In order to improve the transparency of a tea bag and the high-grade feeling it gives, a coarse plain gauze fabric is processed to form a bag shape. However, the resultant tea bag allows much powder leakage. Moreover, the tea bag has a problem regarding in waste treatment.

Japanese Unexamined Patent Publication (Kokai) No. 2001-131826 describes biodegradable monofilaments for tea bags composed of a poly(L-lactic acid), having a size of 15 to 35 dtex, and showing a boil-off shrinkage of 20% or less. However, the invention relates to a tea bag prepared from a plain gauze fabric in which monofilaments are used. The tea bag therefore has the problem that it allows much powder leakage when the transparency of the fabric is increased.

Japanese Unexamined Patent Publication (Kokai) No. 2002-105829 describes a method of making a nonwoven fabric, of a thermoplastic aliphatic polyester filament yarn, flexible by subjecting the fabric to bending treatment. The patent publication discloses a filament yarn nonwoven fabric having a fabric weight of 15 to 200 g/m$^2$, a size of 1.0 to 12 dtex and 4 to 50% of a partial heat contact bonded portion. Moreover, the fabric has no problem about refuse in waste treatment because the fabric is biodegradable. However, there is no description in the patent publication of a nonwoven fabric or a tea bag excellent in transparency, powder leakage, and the like.

Japanese Unexamined Patent Publication (Kokai) No. 9-142485 describes a short fiber nonwoven fabric in which cellulose fiber and biodegradable aliphatic polyester fiber are mixed. The nonwoven fabric contains short fiber that has a size of 1 to 10 denier, is partially heat bonded with a ratio of 5 to 50% or entirely heat bonded, has excellent strength and processability, and is easily degraded by microorganisms. The nonwoven fabric is utilized for a bag for raw refuse, etc. However, there is no description in the patent publication of a nonwoven fabric or a tea bag excellent in transparency, powder leakage, and the like.

Japanese Unexamined Patent Publication (Kokai) No. 7-189136 discloses a light-shielding nonwoven fabric for which a sheath-core yarn is used. A sheath-core conjugate yarn formed out of a polymer as a sheath component that contains a decreased amount of inorganic particles, and a polymer as a core component that contains an increased amount of inorganic particles is used for the nonwoven fabric. Because the nonwoven fabric contains a relatively large amount of inorganic particles in the core component, the nonwoven fabric has excellent shielding properties, and is useful for a printing substrate. However, there is no description in the patent publication of a nonwoven fabric or a tea bag excellent in transparency, powder leakage, and the like.

Although Patent Publication WO 02/48443 discloses a nonwoven fabric material for tea bags that is improved in transparency, there is no description about powder leakage.

DISCLOSURE OF THE INVENTION

An object of the present invention is to solve the above problems, and to provide a nonwoven fabric excellent in transparency, showing decreased powder leakage and excellent bag formability, and causing no refuse problem in waste treatment, and to provide tea bags composed of the nonwoven fabric.

The present inventors have discovered that a nonwoven fabric excellent in transparency and showing decreased powder leakage can be obtained by combining a thermoplastic synthetic fiber material, a content of a delustering agent, a yarn diameter of a yarn forming the nonwoven fabric, a fabric weight, heat contact bonding conditions, and the like, and by further investigating the transparency and the maximum opening diameter of the fiber material. The present invention has thus been achieved.

That is, the present invention is as explained below.

1. A nonwoven fabric characterized in that the nonwoven fabric is a thermoplastic synthetic fiber nonwoven fabric having a fabric weight of 7 to 50 g/m$^2$, an average yarn diameter of 7 to 40 μm, a partial heat contact bonding ratio of 5 to 30% and a content of a delustering agent of 0.5% by weight or less, or a nonwoven fabric laminate the major component of which is the thermoplastic synthetic fiber nonwoven fabric, and that the nonwoven fabric has a maximum opening diameter of 200 to 2,000 μm, and shows a transparency of 50% or more, a powder leakage ratio of 10% by weight or less and a hydrophilicity of less than 10 sec.

2. The nonwoven fabric according to 1 mentioned above, wherein the nonwoven fabric is characterized in that the nonwoven fabric is a thermoplastic synthetic fiber nonwoven fabric having a fabric weight of 12 to 30 g/m$^2$, an average yarn diameter of 12 to 30 μm, a partial heat contact bonding ratio of 5 to 30% and a content of a delustering agent of 0.2% by weight or less, or a nonwoven fabric laminate the major component of which is the thermoplastic synthetic fiber nonwoven fabric, and that the nonwoven fabric has a maximum opening diameter of 400 to 1,650 μm, and shows a transparency of 60% or more, a powder leakage ratio of 5% by weight or less and a hydrophilicity of less than 10 sec.

3. The nonwoven fabric according to 1 mentioned above, wherein the nonwoven fabric is a laminate of a thermoplastic synthetic fiber nonwoven fabric having an average yarn diameter of 7 to 15 μm and a thermoplastic synthetic fiber nonwoven fabric having an average yarn diameter of 15 to 40 μm.

4. The nonwoven fabric according to any one of 1 to 3 mentioned above, wherein the thermoplastic synthetic fiber nonwoven fabric is a spun-bonded nonwoven fabric composed of a polyolefin filament yarn.

5. The nonwoven fabric according to any one of 1 to 3 mentioned above, wherein the thermoplastic synthetic fiber nonwoven fabric is a spun-bonded nonwoven fabric composed of a polyester filament yarn.

6. The nonwoven fabric according to 5 mentioned above, wherein the thermoplastic synthetic fiber nonwoven fabric is a spun-bonded nonwoven fabric composed of an aliphatic polyester filament yarn.

7. The nonwoven fabric according to 6 mentioned above, wherein the aliphatic polyester filament yarn is a filament yarn of a polyester selected from a poly(D-lactic acid), a poly(L-lactic acid), a copolymer of D-lactic acid and L-lactic acid, a copolymer of D-lactic acid and a hydroxycarboxylic acid, a copolymer of L-lactic acid and a hydroxycarboxylic acid, a copolymer of D-lactic acid, L-lactic acid and a hydroxycarboxylic acid, or a blend of these polymers.

8. The nonwoven fabric according to any one of 1 to 7 mentioned above, wherein a synthetic resin or a fibrous material of 2 to 15 g/m$^2$ having a melting point lower than that of the thermoplastic synthetic fiber by 30 to 200° C. is laminated to the thermoplastic synthetic fiber nonwoven fabric.

9. A tea bag prepared by filling a tea material to be extracted, into a bag composed of the nonwoven fabric according to any one of 1 to 8 mentioned above, and sealing the tea material.

10. The tea bag according to 9 mentioned above, wherein the bag is tetrahedral-shaped.

11. The tea bag according to 9 or 10 mentioned above, wherein the tea material to be extracted is black tea, green tea or oolong tea.

The present invention is explained below in detail.

Examples of the thermoplastic synthetic fiber forming the nonwoven fabric in the present invention include polyolefin fiber such as polyethylene fiber, polypropylene fiber and copolymerized polypropylene fiber, polyester fiber such as poly(ethylene terephthalate) fiber, copolymerized polyester fiber and aliphatic polyester fiber, composite yarn of core-sheath structure composed of a sheath that is formed out of polyethylene, polypropylene, copolymerized polyester, aliphatic polyester, or the like, and a core that is formed out of polypropylene, poly(ethylene terephthalate), or the like, and biodegradable fiber of poly(lactic acid), poly(butylene succinate), poly(ethylene succinate), or the like. Short fiber or filament yarn is used for the above fibers.

These fibers may be used singly, or at least two of them may be used as a laminate. For example, a laminated nonwoven fabric obtained by stacking a filament yarn nonwoven fabric and short fiber, and heat embossing the stacked materials may be used.

In the present invention, the nonwoven fabric of thermoplastic synthetic fiber has a fabric weight of 7 to 50 g/m$^2$, preferably 10 to 40 g/m$^2$, and more preferably 12 to 30 g/m$^2$. When the fabric weight is in the above range, the nonwoven fabric shows good transparency, has suitable gaps among yarns, and exhibits decreased powder leakage.

In the present invention, the nonwoven fabric of thermoplastic synthetic fiber has an average yarn diameter of 7 to 40 μm, preferably 10 to 35 μm, and more preferably 12 to 30 μm. When the average yarn diameter is in the above range, the nonwoven fabric shows good transparency and decreased powder leakage.

In the present invention, the partial heat contact bonding ratio of the nonwoven fabric of thermoplastic synthetic fiber is from 5 to 30%, and preferably from 7 to 27%. Partial heat contact bonding of the nonwoven fabric decreases gaps among yarns forming the nonwoven fabric, and can adjust the transparency, powder leakage, strength, stiffness, and the like of the nonwoven fabric. When the partial heat contact bonding ratio is less than 5%, bonded portions formed by contact bonding are decreased, and powder leakage increases. On the other hand, when the partial heat contact bonding ratio exceeds 30%, the powder leakage is decreased, and the transparency is improved because bonded portions are increased; however, the feel of the fabric is likely to become stiff, and the liquid permeability tends to lower. In addition, the partial heat contact bonding ratio represents a ratio of an area of heat contact bonded portions to the entire area of the nonwoven fabric.

Examples of the method of partial heat contact bonding include a method comprising passing a nonwoven fabric through a pair of heating rolls consisting of an emboss roll having an uneven surface structure and a flat roll having a smooth surface, thereby forming heat contact bonded portions uniformly dispersed over the entire nonwoven fabric.

Because a higher transparency (poor shielding properties) of the nonwoven fabric of the invention is preferred, a decreased amount of an inorganic additive, that is a delustering agent in the yarn forming the nonwoven fabric of thermoplastic synthetic fiber, is preferred. Accordingly, a nonwoven fabric of a bright yarn or an ultra-bright yarn is preferred. The content of the delustering agent is preferably 0.5% by weight or less, and more preferably 0.2% by weight or less. Although examples of the delustering agent include conventionally used metal oxides such as titanium oxide, magnesium stearate and calcium stearate, titanium oxide is preferred in view of the particle stability and spinning stability.

For the nonwoven fabric of the invention, a combination of a thin yarn layer and a thick yarn layer further improves the powder leakage and transparency. For example, a laminate of a nonwoven fabric of thermoplastic synthetic fiber having an average yarn diameter as thin as 7 to 15 μm and a fabric weight of 3 to 20 g/m$^2$ and a nonwoven fabric of thermoplastic synthetic fiber having an average yarn diameter as thick as 15 to 40 μm and a fabric weight of 4 to 30 g/m$^2$ is preferred.

Because the nonwoven fabric of the present invention is used in a bag-shaped article such as a tea bag, it is preferred that the nonwoven fabric show a high bonding strength when heat sealed by a bag-making machine. In order for the nonwoven fabric of thermoplastic synthetic fiber to show good bonding strength and good heat sealability, a synthetic resin or a fibrous material of the resin having a melting point lower than that of the nonwoven fabric by preferably 30 to 200° C., more preferably 50 to 160° C. is preferably laminated to the nonwoven fabric of thermoplastic synthetic fiber on at least one side in an amount of 2 to 15 g/m$^2$, and more preferably 4 to 12 g/m$^2$.

As a result of laminating a synthetic resin or a fibrous material thereof having a melting point lower than that of a nonwoven fabric of thermoplastic synthetic fiber to the nonwoven fabric, whereby the laminate is made to have a difference in melting point between the two materials, the synthetic resin or fibrous material alone having a low melting point is softened or melted during heat sealing, and acts as an adhesive to effectively give a high heat sealing strength.

When the lamination amount of the synthetic resin or fibrous material having a low melting point is in the above range, an amount of a material that contributes as an adhesive is suitable, and an adequate heat seal strength is obtained. Moreover, the transparency of the nonwoven fabric is high, and the production cost is low. In addition, the heat seal strength is preferably 1 N/5 cm or more, and more preferably 3 N/5 cm or more.

Examples of the synthetic resin or fibrous material thereof having a low melting point include a polyolefin resin such as a linear low density polyethylene, a low density polyethylene, a polypropylene and a copolymerized polypropylene, a polyester resin such as a linear polyester and a copolymerized polyester, a synthetic resin such as an ethylene-vinyl acetate copolymer resin, a polyamide resin and a synthetic rubber resin or a fibrous material of the synthetic resin, a composite fiber having a core-sheath structure that is composed of a combination of a low melting point sheath component such as a polyethylene, a polypropylene or a copolymerized polyester, and a high melting point core component such as a polypropylene, a copolymerized polyester, nylon-6 or a poly (ethylene terephthalate), and a low-melting point fiber such as aliphatic acid ester fiber, for example, poly(lactic acid) fiber and poly(butyl succinate) fiber.

Examples of the method of laminating the synthetic resin or a fibrous material thereof having a low melting point to the nonwoven fabric of thermoplastic synthetic fiber include a curtain spraying method comprising melting the resin, and coating the nonwoven fabric with the resultant semi-molten resin or fibrous material thereof, a coating method comprising injecting the resin in a molten state through a nozzle so that the nonwoven fabric is coated with the resin, and a method comprising forming a fiber web out of mixed fiber of a high melting point fiber and a low melting point fiber, or a short fiber of composite fiber by carding procedure or an air-lay procedure, stacking the fiber web and the nonwoven fabric of thermoplastic synthetic fiber, and bonding the stacked materials with a heat roll, or the like, to give a laminate of a nonwoven fabric.

Furthermore, in the present invention, it is preferred that the nonwoven fabric of thermoplastic synthetic fiber causes no problem in waste treatment, and that the nonwoven fabric be the one of aliphatic polyester filament yarn composed of a biodegradable resin.

For example, a poly(lactic acid) polymer is preferably used as the biodegradable resin. Preferred examples of the poly (lactic acid) polymer include a poly(D-lactic acid), a poly(L-lactic acid), a copolymer of D-lactic acid and L-lactic acid, a copolymer of D-lactic acid and a hydroxycarboxylic acid, a copolymer of L-lactic acid and a hydroxycarboxylic acid, a copolymer of D-lactic acid and L-lactic acid and a hydroxycarboxylic acid, or a blend of these polymers. The melting points of the above polymers are preferably 100° C. or more.

Examples of the hydroxycarboxylic acid used for the above poly(lactic acid) polymer include glycolic acid, hydroxybutyric acid, hydroxyvaleric acid, hydroxypentanoic acid, hydroxycaproic acid, hydroxyheptanoic acid and hydroxyoctanoic acid. Of these acids, glycolic acid and hydroxycaproic acid are preferred.

Although there is no specific limitation on the molecular weight of the poly(lactic acid) polymer, the weight average molecular weight is from 10,000 to 1,000,000, and preferably from 30,000 to 500,000 in view of the spinnability and the filament strength.

In order to increase the heat resistance, mechanical strength, polymerization degree, flexibility, and the like, additives such as a nucleating agent are added to the above polymer. Examples of the nucleating agent include talc, titanium oxide, calcium carbonate, magnesium carbonate and carbon. In order to make the crystallinity of poly(lactic acid) fiber fall in a range of 10 to 40%, an addition amount of the nucleating agent is preferably 0.5% by weight or less, and more preferably 0.2% by weight or less. When the crystallinity of the polymer is in the above range, the heat resistance and mechanical strength of the polymer is sufficient, and the heat contact bondability and biodegradability of the polymer are good.

There is no specific restriction on the method of producing the nonwoven fabric. Known methods such as spin bonding, needle punching, air laying and water needling can be applied thereto. For example, when the spin bonding method is used, the method comprises melting a synthetic resin with a melt spinning apparatus, injection spinning the molten resin through a spinneret, drawing the spun yarn with an air sucker, or the like, opening and collecting the spun yarn on a conveyor net, passing the yarn between an emboss roll and a smoothing roll, and partial heat contact bonding the resultant web with a heat emboss roll to give a nonwoven fabric.

In the present invention, a spin-bonded nonwoven fabric composed of a polyolefin filaments yarn or a polyester filaments yarn is a preferred nonwoven fabric because the formation is uniform, and in particular a uniform nonwoven fabric can be obtained with low fabric weight. The uniform nonwoven fabric with low fabric weight has the following advantages: no uneven fabric weight appears; gaps among yarns become uniform; distribution of the pore diameter becomes uniform; and the disadvantage that powder leakage caused by large pores disappears. The spun-bonded nonwoven fabric is preferred because it has a large strength with low fabric weight. For example, the variation ratio of a fabric weight, 10 cm×10 cm, is 10% or less, more preferably 7% or less, and still more preferably 5% or less. In addition, variation ratio of a fabric weight (%)=[(standard deviation)/(average fabric weight)]×100

The nonwoven fabric of the present invention has a maximum opening diameter of 200 to 2,000 μm, preferably 300 to 1,800 μm, and more preferably 400 to 1,650 μm. When the maximum opening diameter is less than 200 μm, gaps among yarns forming the nonwoven fabric are decreased, and the powder leakage is reduced; however, the transparency becomes insufficient. On the other hand, when the maximum opening diameter exceeds 2,000 μm, gaps among the yarns are increased, and the transparency is improved; however, the powder leakage is increased.

FIG. 1 shows the relationship (line 1, left hand side scale) between a maximum opening diameter and a transparency in examples of the invention, and the relationship (line 2, right hand side scale) between a maximum opening diameter and a powder leakage ratio. The following are evident from FIG. 1: when the maximum opening diameter is 200 μm or more, the transparency of the nonwoven fabric is markedly improved, and the powder leakage is low; however, when the maximum opening diameter exceeds 2,000 μm, the powder leakage ratio tends to rapidly increase. That is, for a nonwoven fabric, improvement of the transparency and suppression of the powder leakage conflict each other. However, the present inventors have made improvement of the transparency and suppression of the powder leakage compatible by making the maximum opening diameter fall in a range of 200 to 2,000 μm.

The transparency of the nonwoven fabric of the invention is 50% or more, preferably 55% or more, and more preferably from 60 to 100%. When the transparency is less than 50%, the contents are hardly seen through the tea bag material, and the state thereof is unclear. The transparency is obtained, as described later, by measuring an Lw value of a white board and an Lb value of a black board with a Macbeth spectrometer, and determining the difference between the Lw value and the Lb value.

The powder leakage ratio of the nonwoven fabric of the invention is 10% by weight or less, preferably 7% by weight or less, and more preferably 5% by weight or less. When the powder leakage ratio exceeds 10% by weight, the powder leakage increases. As a result, use of the nonwoven fabric as a tea filter results in leakage of much powder in an extracted solution, and making the tea agreeable becomes difficult due to the high content of a solid powder component. In addition, the method of measuring powder leakage ratio is as described later.

The nonwoven fabric of the present invention is preferably excellent in hydrophilicity so that it is rapidly submerged under water without floating on the surface when it is placed in hot water. The hydrophilicity of the nonwoven fabric of the invention is less than 10 sec, preferably less than 7 sec, and more preferably less than 5 sec. In order to make the hydrophilicity fall in a range of less than 10 sec, the nonwoven fabric should be coated with, for example, a hydrophilic agent in an amount of 0.05 to 5.0% by weight, and preferably 0.1 to 3% by weight. In addition, when a coating amount of the hydrophilic agent is excessive, the hydrophilic agent is dissolved. As result, use of the nonwoven fabric for food applications such as a tea bag causes a problem.

Examples of the hydrophilic agent include an aqueous solution, an ethyl alcohol solution or an ethyl alcohol-water mixture solution of such a surfactant used for food as a sorbitan aliphatic acid ester, a polyglycerin aliphatic acid ester or a sucrose aliphatic acid ester. Known methods such as a gravure roll system, a kiss roll system, an immersion system or a spray system can be used as the coating method.

The average apparent density of the nonwoven fabric of the present invention is preferably from 0.05 to 0.25 g/cm$^3$, and more preferably from 0.08 to 0.22 g/cm$^3$. The average apparent density is related to a feel, stiffness, transparency and powder leakage of the nonwoven fabric. When the average apparent density falls in the above range, the nonwoven fabric is excellent in strength, flexibility and transparency, and shows reduced powder leakage because gaps among the yarns are suitable. Moreover, the nonwoven fabric shows excellent bag formability during bag forming.

The nonwoven fabric of the present invention is useful as a nonwoven fabric for a tea filter, and is preferably used as tea bags prepared by subjecting the fabric to bag-making processing to form flat or tetrahedral-shaped bags, and filling a material to be extracted into the bags. There is no specific restriction on the method of bag-making processing. For example, heat sealing, melt sticking sealing, melt cutting sealing, ultrasonic sealing, high frequency sealing, or the like sealing can be employed. Furthermore, known bag-making machines can be used.

As a material to be extracted, for example, as tea leaves, black tea, green tea or oolong tea is common. However, the material to be extracted is not restricted to the above teas, and roasted tea, green tea of a middle grade, barley tea, a herb, or the like, may also be utilized.

The tea bag of the present invention may be a flat bag. However, a tea bag having a three-dimensional shape is preferred for the following reasons: the tea bag has a space, and tea leaves can be well observed before immersion in hot water; moreover, when the tea bag is placed in water, the state of the tea can be observed much better; because the volume within the tea bag is large, swelling and spreading of the tea leaves are good, and the tea is quickly extracted. Preferred examples of the three-dimensional shape include a tetragonal shape such as a triangular cone shape or a TetraPak shape.

In general, tea bags having a three-dimensional shape are filled with material to be extracted, packed in boxes, and marketed. The tea bags each have a folded shape when packed in boxes. However, when consumers take out the tea bags from the boxes and use them, each tea bag preferably recovers the initial three-dimensional shape rapidly. Because the nonwoven fabric of the present invention has an average yarn diameter as thick as 7 to 40 μm, it has good resilient properties and a suitable stiffness. As a result the nonwoven fabric is excellent in a three-dimensional shape recovery.

BEST MODE FOR CARRYING OUT THE INVENTION

Figure 1:
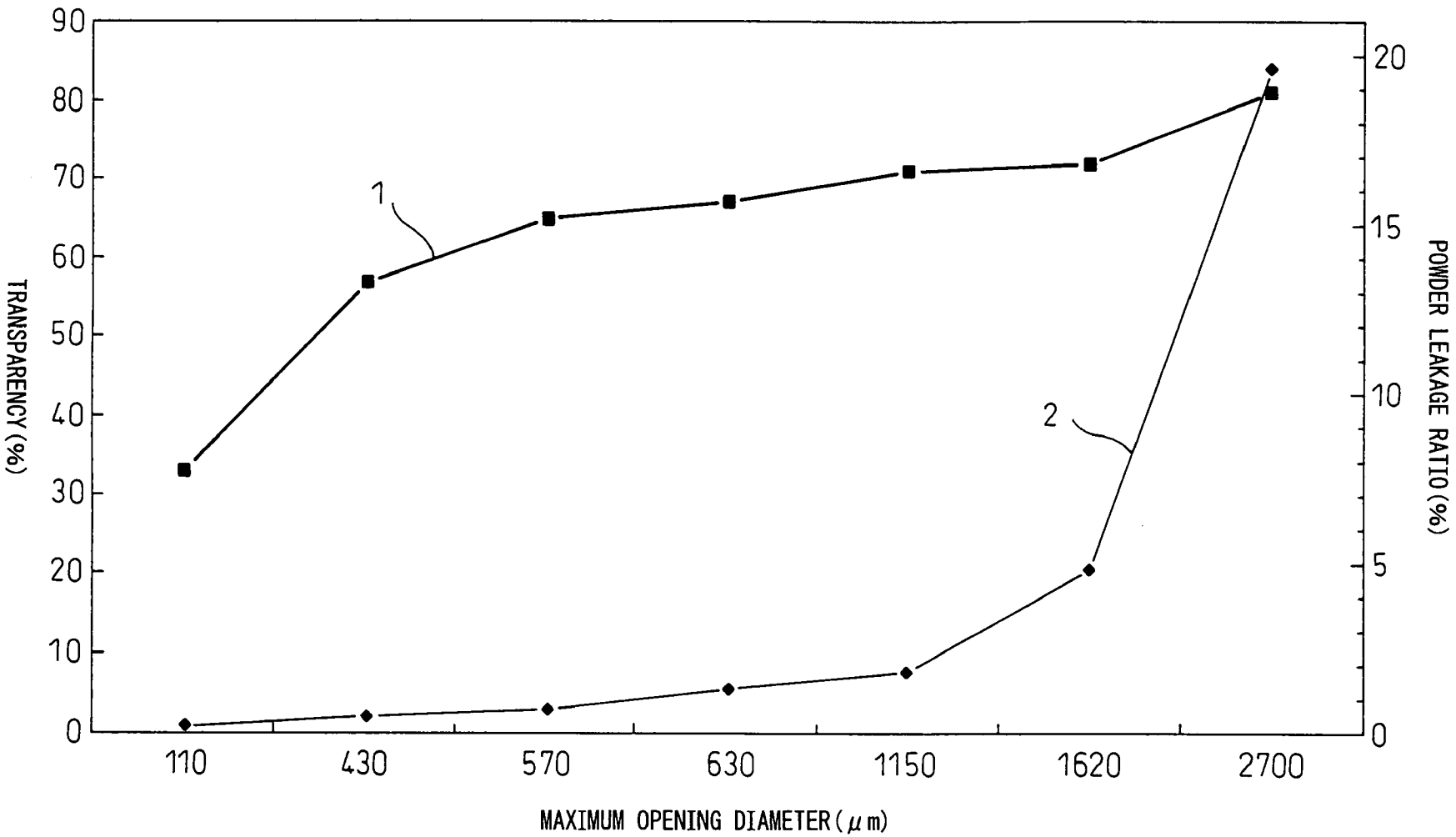
FIG. 1 is a graph showing the relationship (line 1: left hand side scale) between a maximum opening diameter and a transparency of a nonwoven fabric in examples of the present invention, and the relationship (line 2: right hand side scale) between a maximum opening diameter and a powder leakage ratio thereof.

The present invention is further explained below by making reference to examples. However, the present invention is in no way restricted thereto.

In addition, measurement methods, evaluation methods, and the like, are as explained below.

(1) Fabric Weight (g/m$^2$)

Measurements are made in accordance with JIS L 1906. Samples, each 20 cm (longitudinal)×25 cm (lateral), are cut out at three sites, respectively. The weight of each sample is determined, and the fabric weight in terms of weight per unit area is obtained from the average.

(2) Average Yarn Diameter (μm)

Microscopic photographs of yarns are taken at magnifications of ×500. The average yarn diameter is obtained from an average of 10 yarns.

(3) Transparency (%)

The reflectivity of a sample is measured with a Macbeth spectrometer of CE-3000 type (manufactured by Sakata Ink Co., Ltd.). A difference between a white board Lw0 value and a black board Lb0 value is used as a standard. From an Lw value and an Lb value of a sample, the transparency of the sample is determined from the following formula:

$$\text{transparency (\%)}=[\Delta L/\Delta L0]\times 100$$

wherein $\Delta L0=Lw0-Lb0$, and $\Delta L=Lw-Lb$.

(4) Powder Leakage Ratio (wt. %)

About 2 g of a filtering material for spinning (metal powder CR 53, particle size classification of 25/50 mesh, 650/300 μm, manufactured by Taiheiyo Metal) is weighed out, and the weight W1 (g) is measured. The filtering material is placed on a nonwoven fabric, 25 cm×25 cm, and shaken at 60 rpm for about 5 minutes with a shaking machine. The weight W2 (g) of a filtering material that has passed through the nonwoven fabric is then measured, and the powder leakage ratio is obtained from the following formula:

$$\text{powder leakage ratio (wt. \%)}=[W2/W1]\times 100$$

(5) Air Permeability

The air permeability is obtained in accordance with JIS L-1906 (Frajure method).

(6) Hydrophilicity

The hydrophilicity is measured in accordance with JIS L-1906 (dropping method). Water is dropped on a sample, and a time necessary for the sample to permeate is measured. The results are evaluated according to the following criteria:

◎: Water permeates the sample within 5 sec.

O: Water permeates the sample within 10 sec.

X: Water does not permeate the sample for 10 sec or more.

(7) Average Apparent Density

The apparent density of a sample in terms of a weight per unit volume is obtained from a fabric weight and a thickness of the sample under a load of 10 kPa. The average apparent density of the sample is obtained from an average of the measured values at three sites.

(8) Maximum Opening Diameter

The maximum opening diameter is obtained in accordance with JIS K-3832 (bubble point method).

A circular sample 40 mm in diameter is immersed in a liquid so that all the pores of the sample are filled with the liquid by capillary action. Air pressure is gradually applied to the sample from the back side thereof. When the air pressure overcomes a liquid surface tension within a capillary tube, an air bubble comes out; the air pressure is measured. The initial bubble comes out of an opening having the maximum opening diameter. The maximum opening diameter can be calculated by determining the air pressure when the initial bubble comes out.

(9) Seal Strength

Six samples, each being 5 cm wide and 30 cm long, are cut out from a nonwoven fabric in the longitudinal direction. Six samples are prepared in the same manner except that they are cut out in the lateral direction. Each sample is sealed by ultrasonic waves at three sites with a 1-mm thick round blade-shaped head horn of an ultrasonic wave sealing machine having an output at 40 kHz (manufactured by Brother Industries, Ltd.). Each sealed sample is attached to a tensile testing machine in the vertical direction of the machine. The sample is pulled at a tensile rate of 10 cm/min with a chuck-to-chuck distance of 10 cm, and a maximum strength is measured. The average of the six samples is determined, and defined as a seal strength.

(10) Melt Flow Rate (MFR)

Measurements on a sample are made in accordance with JIS K-7210 "Flow test method of thermoplastic resin" (condition 14 in Table 1: a test temperature of 230° C. and a test load of 21.18 N), and the MFR is determined.

(11) Intrinsic Viscosity ([η])

The intrinsic viscosity ([η]) is a value obtained from the following definition formula:

$$[\eta]=\lim_{C\to 0}(\eta_r-1)/C$$

wherein $\eta_r$ (that is defined as a relative viscosity) is a value obtained by dividing a viscosity of a diluted solution at 35° C. of a polymer dissolved in an o-chlorophenol solvent having a purity of 98% or more by the viscosity of the above solvent determined at the same temperature, and C is a polymer concentration in terms of g/100 ml of the above solution.

EXAMPLES 1 TO 5, COMPARATIVE EXAMPLES 1 TO 3

A known spun bond method was used. A polypropylene resin showing a MFR of 39, and having a titanium oxide content of 0.1% by weight was spun through a spinneret by a melt spinning system. The spun yarn was drawn with a high speed drawing apparatus, opened, and collected to give a fiber web. The procedure was repeated while a fabric weight and a yarn diameter were varied to give various webs. Each web was then heat contact bonded by heat pressing between an emboss roll and a smooth roll to give a spun-bonded, partial heat contact bonded nonwoven fabric of polypropylene filaments yarn.

In any of Examples 1 to 5, each nonwoven fabric was then coated with a sorbitan aliphatic acid ester as a hydrophilic agent by a gravure roll system in an amount of 0.2 to 2.0% by weight, and dried at 130° C. to give a coated nonwoven fabric. In addition, the nonwoven fabrics were not coated with the hydrophilic agent in Comparative Examples 1 to 3.

Furthermore, in each of Examples 4 and 5, two types of thermoplastic synthetic fiber webs differing from each other in a yarn diameter and a fabric weight were used as an upper layer and a lower layer, respectively, to give laminate of nonwoven fabrics.

Table 1 shows properties of the nonwoven fabrics thus obtained. In addition, the numerical values in parentheses in the column of "air permeability" are values each obtained from a sample prepared by stacking two initial samples.

TABLE 1

| | | Example | | | | | Comp. Example | | |
|---|---|---|---|---|---|---|---|---|---|
| | | 1 | 2 | 3 | 4 | 5 | 1 | 2 | 3 |
| Upper layer | Fabric weight (g/m$^2$) | 12 | 25 | 40 | 15 | 10 | 10 | 65 | 40 |
| | Average yarn diameter (μm) | 20 | 25 | 27 | 30 | 18 | 44 | 15 | 27 |
| Lower layer | Fabric weight (g/m$^2$) | — | — | — | 10 | 15 | — | — | — |
| | Average yarn diameter (μm) | — | — | — | 25 | 25 | — | — | — |
| Fabric weight (g/m$^2$) | | 12 | 25 | 40 | 25 | 25 | 10 | 60 | 40 |
| Partial heat contact bonding ratio (%) | | 25 | 15 | 10 | 15 | 15 | 5 | 35 | 10 |
| Coating amount of hydrophilic agent(wt. %) | | 0.2 | 0.4 | 2.0 | 0.2 | 0.3 | 0 | 0 | 0 |
| Average apparent density (g/cm$^3$) | | 0.11 | 0.15 | 0.22 | 0.14 | 0.15 | 0.04 | 0.35 | 0.22 |
| Air permeability (ml/cm$^2$/sec) | | (180) | 250 | 210 | 295 | 280 | (235) | 75 | 210 |
| Transparency(%) | | 75 | 71 | 60 | 77 | 70 | 80 | 30 | 34 |
| Powder leakage ratio (wt. %) | | 4.5 | 1.5 | 0.7 | 2.5 | 1.0 | 19.5 | 0.2 | 0.7 |
| Hydrophilicity(sec) | | ◎ | ◎ | ◎ | ◎ | ◎ | X | X | X |
| Maximum opening diameter (μm) | | 1650 | 650 | 350 | 750 | 650 | 2800 | 125 | 345 |
| Seal strength (N/5 cm) | Longitudinal | 6.0 | 13.5 | 18.5 | 12.0 | 13.0 | 0.6 | 26.0 | 18.0 |
| | Lateral | 4.0 | 7.5 | 12.5 | 8.5 | 7.2 | 0.3 | 17.5 | 12.0 |
| Content of delustering agent (wt %) | | 0.1 | 0.1 | 0.1 | 0.1 | 0.1 | 0.1 | 0.1 | 0.7 |

It can be understood from Table 1 that the nonwoven fabrics of the present invention (Examples 1 to 5) were excellent in transparency and hydrophilicity and showed decreased powder leakage. Moreover, as a result of measuring a variation ratio of a fabric weight, the ratio was 6.5% in Example 2, and 4.7% in Example 5.

In contrast to the above results, the nonwoven fabric in Comparative Example 1 showed much powder leakage and poor hydrophilicity because the fabric had no hydrophilic agent coating, although the fabric showed good transparency. Moreover, the nonwoven fabric in Comparative Example 2 had large fabric weight, and a high density of the yarn forming the fabric, and as a result, the fabric showed decreased powder leakage; however, the fabric showed considerably lowered transparency, and poor hydrophilicity because the fabric had no hydrophilic agent coating. The nonwoven fabric in Comparative Example 3 had a large content of a delustering agent, and as result the fabric showed lowered transparency.

EXAMPLES 6 TO 10, COMPARATIVE EXAMPLES 4 TO 5

A partially heat contact bonded, spin-bonded nonwoven fabric of a polyester filaments yarn was obtained in the same manner as in Example 1 except that a bright resin of a poly (ethylene terephthalate) (intrinsic viscosity of 0.76, titanium oxide content of 0.05% by weight) was used in place of the polypropylene resin.

The nonwoven fabrics were then coated with a sorbitan aliphatic acid ester as a hydrophilic agent in an amount of 0.1 to 0.5% by weight with a gravure roll, and dried at 130° C. In addition, the nonwoven fabrics in Comparative Examples 4 and 5 were not coated with a hydrophilic agent.

Furthermore, in each of Examples 9 and 10, two types of thermoplastic synthetic fiber webs differing from each other in a yarn diameter and a fabric weight were used as an upper layer and a lower layer, respectively, to give a laminate of nonwoven fabrics.

Table 2 shows properties of the nonwoven fabrics thus obtained. In addition, the numerical values in parentheses in the column of "air permeability" are values each obtained from a sample prepared by stacking two initial samples.

It can be understood from Table 2 that the nonwoven fabrics of the present invention (Examples 6 to 10) were excellent in transparency and hydrophilicity and showed decreased powder leakage.

In contrast to the above results, the nonwoven fabric in Comparative Example 4 showed much powder leakage and poor hydrophilicity, although the fabric showed good transparency. Moreover, because the yarn forming the nonwoven fabric in Comparative Example 5 had a large yarn density, the fabric showed decreased powder leakage; however, the fabric showed poor transparency and hydrophilicity.

EXAMPLES 11 TO 15, COMPARATIVE EXAMPLES 6 TO 7

A partially heat contact bonded nonwoven fabric of an aliphatic polyester filaments yarn was obtained in the same manner as in Example 1 except that a biodegradable resin (titanium oxide content of 0.03% by weight) of a poly(lactic acid)(copolymerization ratio (molecular ratio) of D form/L form of 1.5/98.5; melting point of 173° C.; MFR of 13 g/10 min) was used in place of the polypropylene resin.

The nonwoven fabrics were then coated with a sorbitan aliphatic acid ester as a hydrophilic agent in an amount of 0.2% by weight with a gravure roll, and dried at 130° C. In addition, the fabrics in Comparative Examples 6 and 7 were not coated with a hydrophilic agent.

Furthermore, in each of Examples 14 and 15, two types of thermoplastic synthetic fiber webs differing from each other in a yarn diameter and a fabric weight were used as an upper layer and a lower layer, respectively, to give a laminate of nonwoven fabrics.

Table 3 shows properties of the nonwoven fabrics thus obtained. In addition, the numerical values in parentheses in the column of "air permeability" are values each obtained from a sample prepared by stacking two initial samples.

TABLE 2

| | | Example | | | | | Comp. Example | |
|---|---|---|---|---|---|---|---|---|
| | | 6 | 7 | 8 | 9 | 10 | 4 | 5 |
| Upper layer | Fabric weight (g/m$^2$) | 12 | 20 | 40 | 8 | 10 | 10 | 65 |
| | Average yarn diameter (μm) | 19 | 22 | 24 | 14 | 14 | 45 | 13 |
| Lower layer | Fabric weight (g/m$^2$) | — | — | — | 8 | 15 | — | — |
| | Average yarn diameter (μm) | — | — | — | 18 | 25 | — | — |
| Fabric weight (g/m$^2$) | | 12 | 20 | 40 | 16 | 25 | 10 | 65 |
| Partial heat contact bonding ratio (%) | | 25 | 15 | 10 | 25 | 15 | 3 | 40 |
| Coating amount of hydrophilic Agent (wt. %) | | 0.1 | 0.2 | 0.5 | 0.3 | 0.3 | 0 | 0 |
| Average apparent density (g/cm$^3$) | | 0.11 | 0.15 | 0.20 | 0.14 | 0.18 | 0.03 | 0.37 |
| Air permeability (ml/cm$^2$/sec) | | (170) | 230 | 185 | (145) | 220 | (265) | 60 |
| Transparency (%) | | 72 | 67 | 57 | 71 | 65 | 81 | 33 |
| Powder leakage ratio (wt. %) | | 4.8 | 1.3 | 0.5 | 1.8 | 0.7 | 19.6 | 0.2 |
| Hydrophilicity (sec) | | ◎ | ◎ | ◎ | ◎ | ◎ | X | X |
| Maximum opening diameter (μm) | | 1620 | 630 | 430 | 1150 | 570 | 2700 | 110 |
| Seal strength (N/5 cm) | Longitudinal | 4.0 | 10.5 | 15.5 | 6.5 | 12.5 | 0.3 | 21.0 |
| | Lateral | 3.0 | 6.5 | 11.0 | 3.7 | 7.8 | 0.1 | 13.5 |
| Content of delustering agent (wt %) | | 0.05 | 0.05 | 0.05 | 0.05 | 0.05 | 0.05 | 0.05 |

TABLE 3

| | | Example | | | | | Comp. Example | |
|---|---|---|---|---|---|---|---|---|
| | | 11 | 12 | 13 | 14 | 15 | 6 | 7 |
| Upper layer | Fabric weight ($g/m^2$) | 12 | 20 | 30 | 8 | 10 | 11 | 64 |
| | Average yarn diameter (μm) | 14 | 18 | 20 | 12 | 14 | 44 | 13 |
| Lower layer | Fabric weight ($g/m^2$) | — | — | — | 8 | 15 | — | — |
| | Average yarn diameter (μm) | — | — | — | 15 | 20 | — | — |
| Fabric weight ($g/m^2$) | | 12 | 20 | 30 | 16 | 25 | 11 | 64 |
| Partially heat contact bonding ratio (%) | | 25 | 15 | 5 | 25 | 15 | 4 | 38 |
| Coating amount of hydrophilic agent (wt. %) | | 0.1 | 0.2 | 0.5 | 0.1 | 0.2 | 0 | 0 |
| Average apparent density ($g/cm^3$) | | 0.13 | 0.17 | 0.20 | 0.15 | 0.21 | 0.03 | 0.36 |
| Air permeability ($ml/cm^2/sec$) | | (170) | 215 | 190 | (140) | 205 | (260) | 58 |
| Transparency (%) | | 76 | 70 | 64 | 73 | 68 | 80 | 29 |
| Powder leakage ratio (wt. %) | | 3.3 | 1.1 | 0.7 | 1.9 | 0.8 | 19.4 | 0.3 |
| Hydrophilicity (sec) | | ◎ | ◎ | ◎ | ◎ | ◎ | X | X |
| Maximum opening diameter (μm) | | 1650 | 830 | 670 | 960 | 740 | 2560 | 120 |
| Seal strength (N/5 cm) | Longitudinal | 3.7 | 9.5 | 13.5 | 5.8 | 10.7 | 0.3 | 20.5 |
| | Lateral | 2.8 | 6.3 | 10.2 | 4.1 | 7.4 | 0.1 | 13.0 |
| Content of delustering agent (wt %) | | 0.03 | 0.03 | 0.03 | 0.03 | 0.03 | 0.03 | 0.03 |

It can be understood from Table 3 that the nonwoven fabrics of the present invention (Examples 11 to 15) were excellent in transparency and hydrophilicity, showed decreased powder leakage, and were also excellent in biodegradability.

In contrast to the above results, the nonwoven fabric in Comparative Example 6 showed much powder leakage and poor hydrophilicity, although the fabric showed good transparency. Moreover, because the yarn forming the nonwoven fabric in Comparative Example 7 had a large yarn density, the fabric showed decreased powder leakage; however, the fabric showed poor transparency and hydrophilicity.

EXAMPLE 16

The spun-bonded nonwoven fabric of a polypropylene filaments yarn obtained in Example 2 was coated on one side with a fibrous material in an amount of 10 $g/m^2$ by curtain spraying a hot melt resin to give a laminated nonwoven fabric. In addition, a polypropylene resin (trade name of YH 151-1P, manufactured by Hitachi Chemical Polymer Co., Ltd., melting point of 145° C.) was used as the hot melt resin. The melting point difference between the filaments yarn and the hot melt resin was 60° C. The laminated nonwoven fabric thus obtained was then coated with a hydrophilic agent in the same manner as in Example 2 to give a nonwoven fabric.

The nonwoven fabric thus obtained had the following properties: a fabric weight of 35 $g/m^2$; a variation ratio in the fabric weight of 3.8%; a partial heat contact bonding ratio of 15%; a coating amount of a hydrophilic agent of 0.4% by weight; an average apparent density of 0.22 $g/cm^3$; a transparency of 69%; a powder leakage ratio of 1.2% by weight; a maximum opening diameter of 630 μm; and good hydrophilicity (◎). Moreover, the strength of a seal formed by a heat sealing machine at 130° C. was 8.5 N/5 cm (longitudinal) and 4.3 N/5 cm (lateral). The nonwoven fabric was excellent in heat sealability and transparency, showed decreased powder leakage, and was suited to a filter for tea.

EXAMPLE 17

A fiber web was obtained by the air lay system from a composite yarn (average yarn diameter of 18 μm, a yarn length of 51 mm) having a sheath-core structure that is formed out of a poly(ethylene terephthalate) (melting point of 265° C.) as a core and a copolymerized polyester (melting point of 145° C.) as a sheath. The fiber web in an amount of 10 $g/m^2$ and the spun-bonded nonwoven fabric of a polyester filaments yarn obtained in Example 6 were stacked. The stacked materials were passed through smoothing rolls at 160° C. to give a laminate of nonwoven fabrics. The laminate of nonwoven fabrics thus obtained was then coated with a hydrophilic agent in the same manner as in Example 6 to give a nonwoven fabric. The nonwoven fabric thus obtained had the following properties: a fabric weight of 22 $g/m^2$; a variation ratio in the fabric weight of 4.3%; a partial heat contact bonding ratio of 25%; a coating amount of a hydrophilic agent of 0.1% by weight; an average apparent density of 0.20 $g/cm^3$; a transparency of 67%; a powder leakage ratio of 3.2% by weight; a maximum opening diameter of 1,150 μm; and good hydrophilicity (◎). Moreover, the strength of a seal formed by a heat sealing machine at 160° C. was 6.5 N/5 cm (longitudinal) and 4.8 N/5 cm (lateral). The nonwoven fabric was excellent in heat sealability and transparency, showed a decreased powder leakage, and was suited to a filter for tea.

EXAMPLE 18

Example of Tea Bags

A heat seal bag-making machine of three-dimensional forming type (for forming a tetrahedral shape) was used. The nonwoven fabric obtained in Examples 16 or 17 was slit to give a tape-like fabric 125 mm wide. Strings and tags were bonded to the fabric. The fabric was then folded in the direction of width (125 mm), and the edges were heat sealed with a width of 5 mm to form a cylindrical shape. The cylindrically shaped fabric was heat sealed at portions corresponding to the bottom portions at a pitch of 50 mm to give bags.

Two grams of black tea leaves were placed in each bag, and the opening portion of the bag was heat sealed to give a tea bag.

When the tea bag was observed, it was excellent in transparency, and the shape of the tea could be confirmed. When the tea bag was placed in 200 ml of hot water in a cup, the bag was submerged under water in 1 second. One could see the black tea leaves in the tea bag spread and swell. The extracted solution of the black tea was a delicious tea with a powerful scent.

INDUSTRIAL APPLICABILITY

The nonwoven fabric of the present invention is excellent in transparency, shows decreased powder leakage, has heat sealability, was excellent in bag-making processability, and exhibits good biodegradability. The nonwoven fabric is therefore useful as a filter for materials to be extracted such as black tea, green tea and oolong tea.

The tea bag of the present invention prepared by wrapping a particle-shaped material to be extracted, that is, crushed leaves of black tea, green tea, oolong tea, or the like, shows decreased powder leakage, is submerged under hot water without floating when placed therein, and exhibits quick extraction of the tea components. In addition to the above advantages, because the material to be extracted can be seen from the outside of the tea bag material, the tea bag is particularly suited when tea leaves such as leaves of high grade black tea are to be seen through the tea bag material.

The invention claimed is:

1. A nonwoven fabric comprising a thermoplastic synthetic fiber nonwoven fabric having a fabric weight of 7 to 50 g/m$^2$, an average fiber diameter of 7 to 40 μm, a partial heat contact bonding ratio of 5 to 30% and a content of a delustering agent of 0.5% by weight or less, wherein the nonwoven fabric is a laminate of a thermoplastic synthetic fiber spun-bonded nonwoven fabric having an average fiber diameter of 7 to 15 μm and a thermoplastic synthetic fiber spun-bonded nonwoven fabric having an average fiber diameter of 15 to 40 μm, wherein the nonwoven fabric has a variation ratio of a fabric weight, 10 cm×10 cm, of 10% or less and wherein the nonwoven fabric has a maximum opening diameter of 200 to 2,000 μm, and shows a transparency of 50% or more, a powder leakage ratio of 10% by weight or less and a hydrophilicity of less than 10 sec.

2. The nonwoven fabric according to claim 1, wherein the nonwoven fabric is a thermoplastic synthetic fiber nonwoven fabric having a fabric weight of 12 to 30 g/m$^2$, an average fiber diameter of 12 to 30 μm, a partial heat contact bonding ratio of 5 to 30% and a content of a delustering agent of 0.2% by weight or less, wherein the nonwoven fabric is a laminate of a thermoplastic synthetic fiber spun-bonded nonwoven fabric having an average fiber diameter of 12 to 15 μm and a thermoplastic synthetic fiber spun-bonded nonwoven fabric having an average fiber diameter of 15 to 30 μm, and wherein the nonwoven fabric has a maximum opening diameter of 400 to 1,650 μm, and shows a transparency of 60% or more, a powder leakage ratio of 5% by weight or less and a hydrophilicity of less than 10 sec.

3. The nonwoven fabric according to claim 1 or 2 wherein the thermoplastic synthetic fiber spun-bonded nonwoven fabric is a spun-bonded nonwoven fabric composed of a polyolefin filament fiber.

4. The nonwoven fabric according to claim 1 or 2 wherein the thermoplastic synthetic fiber spun-bonded nonwoven fabric is a spun-bonded nonwoven fabric composed of a polyester filament fiber.

5. The nonwoven fabric according to claim 4, wherein the thermoplastic synthetic fiber spun-bonded nonwoven fabric is a spun-bonded nonwoven fabric composed of an aliphatic polyester filament fiber.

6. The nonwoven fabric according to claim 5, wherein the aliphatic polyester filament fiber is a filament fiber of a polyester selected from a poly(D-lactic acid), a poly(L-lactic acid), a copolymer of D-lactic acid and L-lactic acid, a copolymer of D-lactic acid and a hydroxycarboxylic acid, a copolymer of L-lactic acid and a hydroxycarboxylic acid, a copolymer of D-lactic acid, L-lactic acid and a hydroxycarboxylic acid, or a blend of these polymers.

7. The nonwoven fabric according to claim 1 or 2, wherein a synthetic resin or a fibrous material of 2 to 15 g/m$^2$ having a melting point lower than that of the thermoplastic synthetic fiber by 30 to 200° C. is laminated to the thermoplastic synthetic fiber nonwoven fabric.

8. A tea bag prepared by filling a tea material, to be extracted, into a bag composed of the nonwoven fabric according to claim 1 or 2, and sealing the tea material.

9. The tea bag according to claim 8, wherein the bag is tetrahedral-shaped.

10. The tea bag according to claim 8, wherein the tea material to be extracted is black tea, green tea or oolong tea.

* * * * *